US008932145B2

(12) United States Patent
Hachiro

(10) Patent No.: US 8,932,145 B2
(45) Date of Patent: Jan. 13, 2015

(54) GOLF CLUB GRIP

(75) Inventor: Toshihiko Hachiro, Osaka (JP)

(73) Assignee: Iomic Inc., Osaka (JP)

( * ) Notice: Subject to any disclaimer, the term of this patent is extended or adjusted under 35 U.S.C. 154(b) by 101 days.

(21) Appl. No.: 13/581,572

(22) PCT Filed: Sep. 27, 2011

(86) PCT No.: PCT/JP2011/072037
§ 371 (c)(1),
(2), (4) Date: Aug. 28, 2012

(87) PCT Pub. No.: WO2013/031033
PCT Pub. Date: Mar. 7, 2013

(65) Prior Publication Data

US 2013/0090183 A1 Apr. 11, 2013

(30) Foreign Application Priority Data

Aug. 31, 2011 (JP) ..... 2011-188592

(51) Int. Cl.
*A63B 53/14* (2006.01)

(52) U.S. Cl.
USPC ..... 473/300; 473/303

(58) Field of Classification Search
USPC ..... 473/300–303, 296–299, 286, 285
See application file for complete search history.

(56) References Cited

U.S. PATENT DOCUMENTS

| | | | | |
|---|---|---|---|---|
| 2,782,035 | A * | 2/1957 | East | 473/297 |
| 2,960,133 | A * | 11/1960 | Shepherd, Jr. | 81/22 |
| 5,145,171 | A * | 9/1992 | Head et al. | 473/300 |
| 6,022,278 | A * | 2/2000 | Vela | 473/201 |
| 6,890,265 | B2 * | 5/2005 | Enlow | 473/201 |
| 7,931,544 | B2 * | 4/2011 | Gill | 473/300 |
| 7,980,962 | B2 * | 7/2011 | Fujimoto | 473/300 |
| 2003/0084756 | A1 * | 5/2003 | Schroder et al. | 81/20 |
| 2004/0043827 | A1 * | 3/2004 | Lamkin et al. | 473/300 |
| 2006/0270488 | A1 * | 11/2006 | Takeuchi | 473/300 |
| 2008/0312005 | A1 * | 12/2008 | Hung | 473/300 |
| 2010/0190569 | A1 * | 7/2010 | Chen et al. | 473/300 |
| 2010/0304882 | A1 * | 12/2010 | Gill et al. | 473/297 |
| 2011/0124431 | A1 * | 5/2011 | Karube | 473/300 |
| 2011/0143853 | A1 * | 6/2011 | Walls | 473/300 |
| 2012/0302364 | A1 * | 11/2012 | Boccieri | 473/300 |

FOREIGN PATENT DOCUMENTS

| | | | | |
|---|---|---|---|---|
| JP | 60-66366 | | 5/1985 | |
| JP | 61-50575 | | 3/1986 | |
| JP | 04226680 | A * | 8/1992 | A63B 53/14 |
| JP | 5-168733 | | 7/1993 | |

(Continued)

*Primary Examiner* — Stephen L. Blau
(74) *Attorney, Agent, or Firm* — 24IP Law Group; Timothy R DeWitt

(57) ABSTRACT

To provide an inexpensive golf club grip with an improved feel of grip and ball direction control.

A grip 10 has a double structure in a certain region 12. The grip 10 includes a grip main body 14 made of a soft resin and an end cap 15 made of a hard resin. The grip main body 14 is formed by insert molding with the end cap 15 being the insert. The end cap 15 includes a cylindrical portion 13. The cylindrical portion 13 has a specific length in the axial direction. The cylindrical portion 13 is inserted into a rear end portion of the grip main body 14. Thus, the torsional rigidity is improved in the region 12. The grip main body 14 is molded using a pin gate mold so that a gate mark 19 can double as a mark indicative of the center thereof.

17 Claims, 12 Drawing Sheets

(56) References Cited

FOREIGN PATENT DOCUMENTS

| | | |
|---|---|---|
| JP | 2004-275324 | 10/2004 |
| JP | 2008-505717 | 1/2006 |
| JP | 2007-117109 | 5/2007 |
| JP | 2007-275443 | 10/2007 |
| JP | 2008-173978 | 7/2008 |
| JP | 2010-188019 | 9/2010 |
| JP | 4606499 | 9/2010 |

* cited by examiner

GOLF CLUB GRIP

TECHNICAL FIELD

The present invention relates to the structure of a golf club grip.

BACKGROUND ART

A golf club is generally provided with a club head, a shaft and a grip. Grips made from silicone resin, for example, have conventionally been provided. Forming the grip from such a material offers a better feel (comfort) of grip when the golfer grasps the club, and provides a better slip prevention effect and better wear resistance of the grips (Patent Document 1).

The impact angle between the clubface and the ball when the golfer hits the ball largely affects the ball travel direction. It is essential for the clubface to meet the ball at right angles in order for the ball to travel in a direction as intended by the golfer. The golf club receives a large impact force at the hitting moment. It is a conventional understanding that this impact force gives the following effect on the golf club: Specifically, the impact force causes torsional deformation in the shaft. This makes the clubface meet the ball at an angle inclined from the vertical, as a result of which the ball travels in a direction slightly different from the direction intended by the golfer. Various measures have been proposed in the past to reduce torsional deformation in the shaft based on this understanding (see, for example, Patent Documents 2 to 4).

It was conventionally assumed that an angle difference between intended and actual ball travel directions was primarily caused by a twist in the shaft. However, even though the shaft is improved to have higher torsional rigidity, the phenomenon in which the ball travels in a direction not exactly as aimed by the golfer still happens. The present inventor, in investigating the cause of this phenomenon, focused on the fact that the grip, which is a component of a golf club, is significantly more resilient than the shaft. The present inventor then found out that, while the impact force would obviously cause torsional deformation in the shaft, the difference between intended and actual impact angle between the clubface and the ball was actually largely dependent on resilient deformation of the grip caused by this impact force.

The present inventor assumed that an improvement in the conventional grip structure would effectively prevent a difference between intended and actual impact angle between the clubface and the ball. On the other hand, the grip is desired to be made of a soft resin for a better feel of grip as mentioned above. It is obvious that the grip will have lower torsional rigidity if it is made from such a soft material. Thus the present inventor developed, and obtained a patent (see Patent Document 5) of, a golf club grip that offers a good feel of grip and a slip prevention effect, and allows the golfer to hit the ball in a direction as intended.

PRIOR ART REFERENCES

Patent Document

Patent Document 1: Japanese Patent Publication No. 2008-173978 A

Patent Document 2: Japanese Patent Publication No. 2007-275443 A

Patent Document 3: Japanese Patent Publication No. 2004-275324 A

Patent Document 4: Japanese Patent Publication No. 2007-117109 A

Patent Document 5: Japanese Patent No. 4606499 B

SUMMARY OF THE INVENTION

Problems to be Solved by the Invention

The grip disclosed in Patent Document 5 has improved torsional rigidity over the entire region from a front end to a rear end of the grip and provides the advantage of very low torsional deformation at strike. However, this grip had the problem of high cost due to its complex manufacturing process. The reason for the complexity is the structure of this grip having high rigidity over the entire region thereof as noted above.

The present inventor, in further investigating the torsion deformation of the grip when hitting the ball, came to the following finding: Specifically, the present inventor found out that, in order to reduce torsional deformation in the grip, the grip rigidity does not need to be improved over the entire length, and that improving the rigidity only in a certain region provides a significant effect. Improving the rigidity only in a certain region will obviously simplify the manufacturing process and enable cost reduction.

Accordingly, an object of the present invention is to provide a golf club grip that allows the golfer to hit the ball in a direction as intended as well as offers a good feel of grip and a slip prevention effect at low cost.

Solutions to the Problems (1) To achieve the above object, the golf club grip according to the present invention includes a cylindrical grip main body made of a first resin, and an end cap made of a second resin having a higher hardness than the first resin, the end cap being provided at a rear end portion of the grip main body to forma grip end. The grip main body is made by insert molding with the end cap being an insert. The end cap includes a cylindrical portion inserted into the rear end portion of the grip main body, and an end face plate closing a rear end of the grip main body. The cylindrical portion has a length of 60 mm to 75 mm.

This golf club grip has a double structure, with the cylindrical portion of the end cap inserted in the grip main body. Since the grip main body is formed by insert molding with the end cap as the insert, the grip main body is firmly joined and united with the end cap. This golf club grip is attached to the golf club shaft and held by the golfer. Since the grip main body is made of a relatively soft resin, the golf club grip offers good comfort of grip for the golfer. The end cap made of a high-hardness resin is mounted to the rear end portion of the grip main body. More specifically, the cylindrical portion is inserted in the grip main body, and the end face plate closes the rear end of the grip main body. This increases the bending rigidity and buckling rigidity of the rear end portion of the grip main body, so that the golfer can grasp the golf club grip firmly.

With the cylindrical portion inserted in the grip main body, the wall thickness of the grip main body is made relatively small. More specifically, since the golf club grip is to be held by the golfer, its outer diameter and wall thickness are naturally determined within a certain range. Specifically, the wall thickness t of the golf club grip, with the cylindrical portion inserted in the grip main body, is a total sum of the wall thickness t1 of the cylindrical portion and the wall thickness t2 of the grip main body, this wall thickness t being determined to be a certain value. Therefore, because of the cylindrical portion made of a hard material being inserted in the grip main body, the wall thickness of the soft-material portion of the golf club grip (i.e., the wall thickness t2 of the grip main body) is naturally made smaller.

Deformation of the golf club grip is largely dependent on the deformation of the grip main body made of a soft resin (first resin). It then follows that reducing the wall thickness t2 of the grip main body made of the soft resin by insertion of the cylindrical portion made of a hard resin in the grip main body should increase the torsional rigidity of the golf club grip. In other words, the amount of torsional deformation in the golf club grip when hitting the ball is reduced.

The present inventor found out that the overall amount of torsional deformation of the golf club grip was reduced only by setting the length of the cylindrical portion as specified above. That is, the so-called torque performance of the golf club grip as a whole is improved even though the cylindrical portion is not present over the substantially entire region of the grip main body as conventional grips. A quantitative clarification of the cause is yet to be made, but the effect of setting the length of the cylindrical portion as specified above will be demonstrated later with description of examples. Also, with the length of the cylindrical portion set as specified above, the manufacturing process is simplified, so that the golf club grip can be manufactured simply and inexpensively.

(2) The cylindrical portion should preferably have a hole corresponding to a gate of the pin gate mold, the hole extending radially through a rear end portion of the cylindrical portion. In this case, the grip main body should preferably be molded using a pin gate mold.

With this structure, since the grip main body is formed using a pin gate mold, the defect rate is reduced. More specifically, the molded product (golf club grip) has less residual stress after molding, so that the so-called swirl deformation is prevented. Also, since the so-called gate mark is very small, a process step of removing gate marks (typically, a process of cutting off part of the product) is no longer necessary, so that the manufacturing process is further simplified and cost is reduced. Since the hole is disposed at the rear end portion of the cylindrical portion, there is left a small gate mark in this portion. However, such a small gate mark, as it appears near the rear end of the golf club grip, is used as a mark that indicates the center of the golf club grip.

In other words, the technical means, which is that the hole is provided in the cylindrical portion, enables use of a pin gate mold and reduces the defect rate of the product as well as allows the small gate mark inevitably left by the use of the pin gate mold to function as the above-described mark. That is, this technical means plays a subtle, but important, role in reducing the cost and improving the functions of the golf club grip.

(3) The cylindrical portion may be formed with an engaging protrusion on an outer circumferential surface thereof to engage with the grip main body. Such engaging protrusion should preferably have a distal end portion being fused with the grip main body by the insert molding.

With this structure, the engaging protrusion bites into the grip main body radially (in the wall thickness direction), so that the grip main body and the end cap are firmly joined together. Therefore, displacement of the grip main body relative to the end cap when a couple of forces acts on the grip is reduced. In addition, since the wall thickness of the grip main body is further reduced at portions where the engaging protrusion is provided, deformation of the grip main body is further reduced. This accordingly improves the torsional rigidity of the golf club grip.

(4) A plurality of engaging protrusions should preferably be arranged circumferentially at predetermined intervals on the outer circumferential surface of the cylindrical portion.

With this structure, the engaging protrusions are arranged evenly and intermittently on the entire circumferential surface of the cylindrical portion of the end cap, so that portions without the engaging protrusions are also evenly distributed. That is, portions having a relatively larger wall thickness of the grip main body are present evenly on the entire circumferential surface of the golf club grip. Thus the feel of grip when the golfer grasps the grip is further enhanced, while the torsional rigidity of the grip is maintained high.

(5) The engaging protrusion should preferably have a triangular cross-sectional shape with the distal end portion thereof protruding toward the grip main body.

This ensures that the engaging protrusion fuses with the grip main body. Thus the grip main body and the end cap are joined together more firmly.

(6) The engaging protrusion should preferably be a rib extending in a longitudinal direction of the cylindrical portion.

With this structure, this engaging protrusion functions as a key connecting the end cap and the grip main body. The end cap and the grip main body are thus joined even more firmly, so that the golf club grip has even higher torsional rigidity.

(7) The engaging protrusion should preferably extend as far as to or near a surface of the cylindrical outer member.

With this structure, the golfer can feel the presence of the engaging protrusion when the golfer grasps the golf club grip. Since the engaging protrusion is made of the hard resin (second resin), the golfer feels a good contact therewith. In other words, it provides the advantage of a slip prevention effect.

(8) The first resin should preferably have a hardness of 48 to 52 (according to JIS K 6253 Type A).

This structure offers a very good feel of grip when the golfer grasps the golf club grip.

(9) A method of manufacturing the golf club grip described above is proposed. This manufacturing method includes a first step of forming the end cap by injection molding with the second resin; a second step of mounting the end cap in the pin gate mold, with the hole of the injection-molded end cap being aligned with the gate of the pin gate mold; a third step of injecting the first resin from the gate, with the pin gate mold being clamped; and a fourth step of removing a molded golf club grip after the pin gate mold has been opened.

Specifically, the end cap is first fabricated by injection molding. Then, the grip main body is formed by injection molding using a pin gate mold, with this end cap being the insert. The golf club grip is thus manufactured. Use of the pin gate mold reduces the defect rate of the product (golf club grip). More specifically, the molded product (golf club grip) has less residual stress (so-called swirl deformation) after the molding. Also, since the so-called gate mark is very small, a process step of removing gate marks (typically, a process of cutting off part of the product) is no longer necessary, so that the manufacturing process is simplified. The gate mark appears near the rear end of the golf club grip, so that it is utilized as a mark indicating the center of the grip. Since the grip main body is made of a relatively soft resin as mentioned above, the grip offers an excellent feel of grip for the golfer. Furthermore, torsional deformation is reduced due to the above-described structure of the golf club grip.

Effects of the Invention

According to the present invention, since the grip main body is made of a soft resin, the grip offers a good feel of grip for the golfer. The end cap mounted to the grip main body is made of a hard resin, and with the cylindrical portion of the end cap inserted in the rear end portion of the grip main body, the amount of torsional deformation in the entire golf club grip is reduced. This accordingly reduces the twist in the golf club grip when the golfer hits the ball, so that the ball travels in the direction as intended by the golfer. In addition, since the cylindrical portion is inserted only in the rear end portion of the grip main body, the manufacturing process of the golf club grip is simplified, so that the grip can be manufactured at low cost.

EMBODIMENTS OF THE INVENTION

Hereinafter, preferred embodiments of the present invention will be described with reference to the drawings as required.

[General structure of golf club grip]

Figure 1:
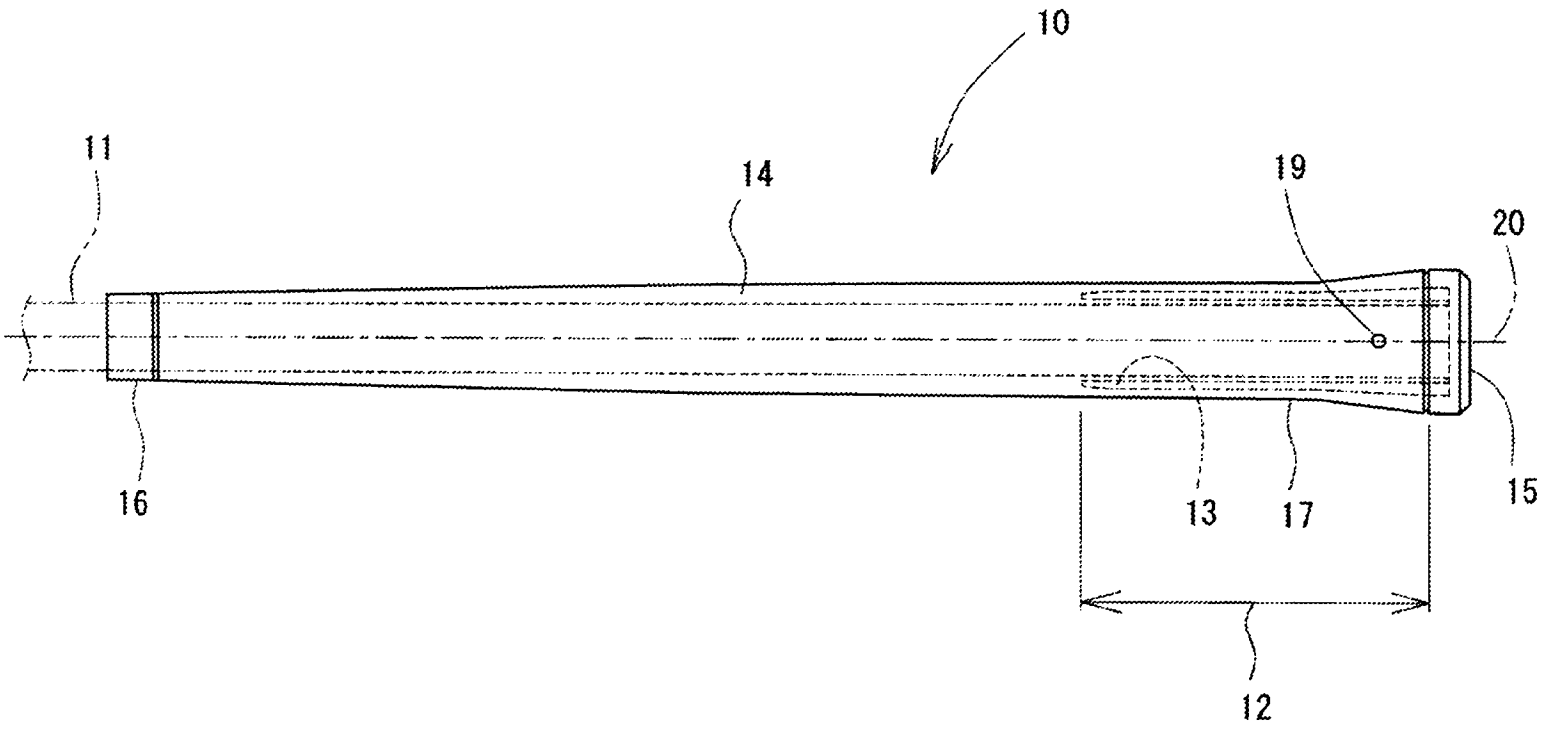
FIG. 1 is a front view of a grip according to one embodiment of the present invention.
Figure 2:
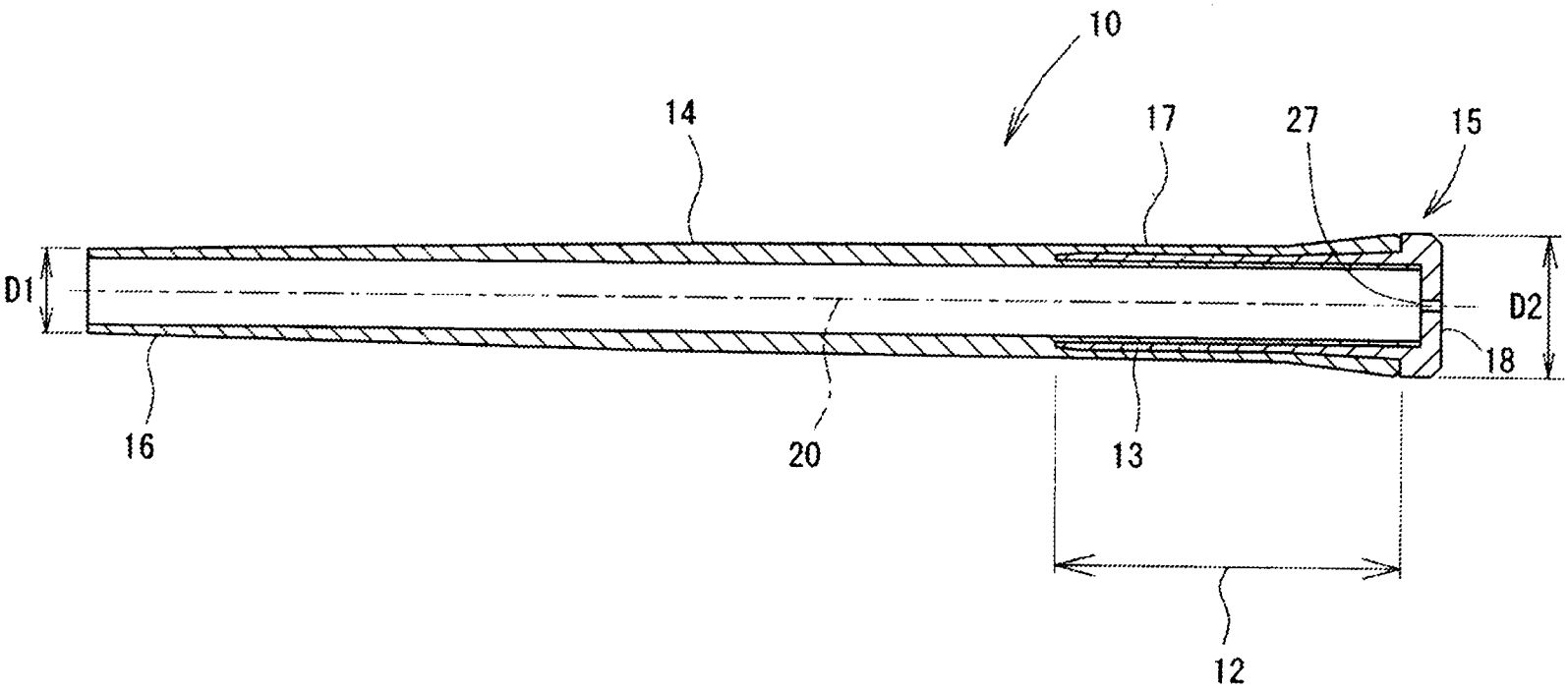
FIG. 2 is a sectional view of the grip according to one embodiment of the present invention.

FIG. 1 is a front view, and FIG. 2 is a sectional view, of a golf club grip (hereinafter referred to as a "grip") 10 according to one embodiment of the present invention.

This grip 10 is attached to a golf club (in particular, a wood club or an iron club). As shown in FIG. 1, the grip 10 is fixedly fitted to the rear end of a shaft 11 of a golf club. The shaft 11 is formed in a rod-like shape having a circular cross section and made of stainless steel, or carbon fiber reinforced plastics and the like. A club head is attached to the distal end of this shaft 11.

This grip 10, being the part held by a golfer using the golf club, is required to have a shape easy to grip for the golfer. For this reason, the grip 10 in this embodiment is formed cylindrical, with a circular cross section. The shaft 11 is inserted into the grip 10. The cross-sectional shape of the grip is not limited to be circular; it may be polygonal.

Figure 3:
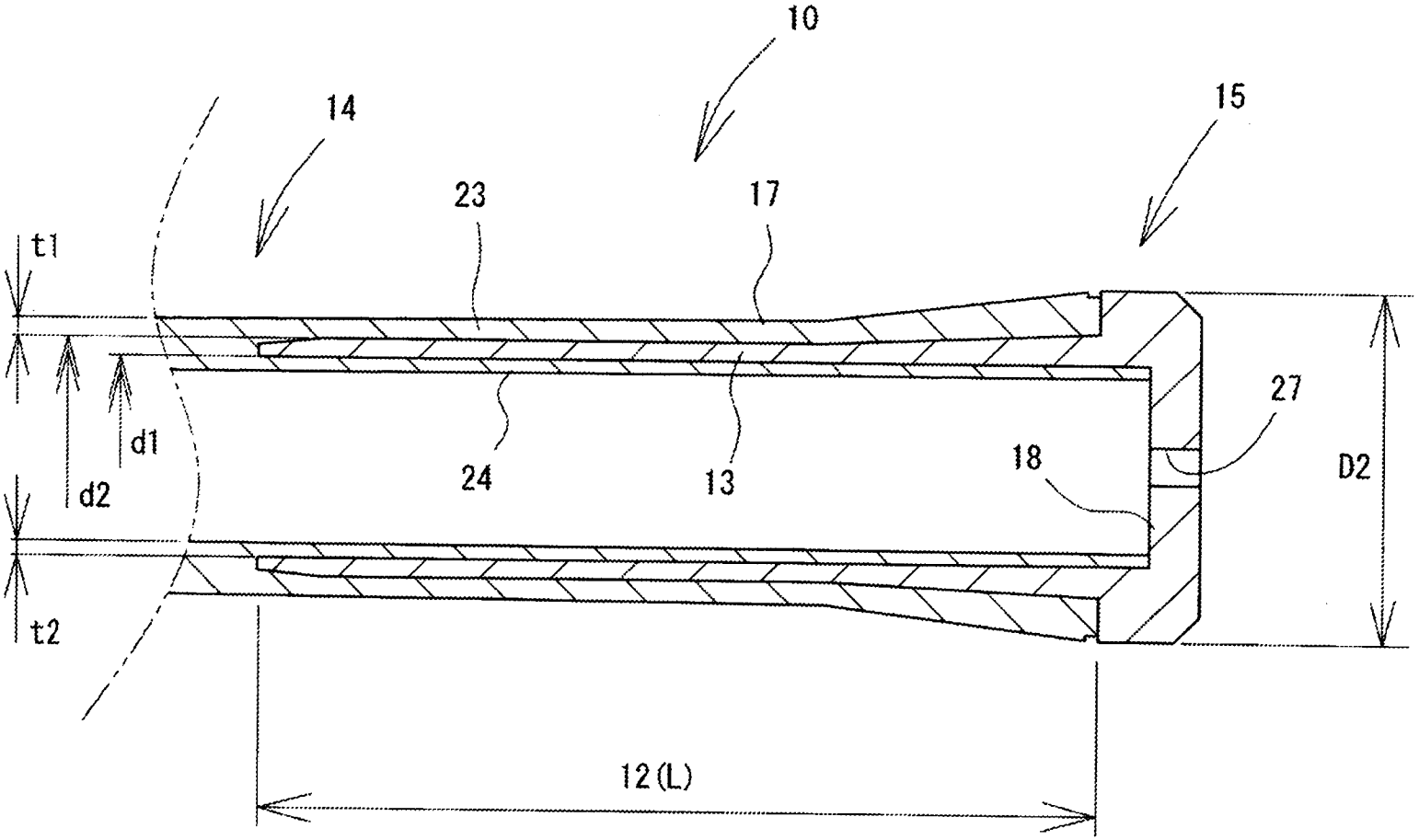
FIG. 3 is an enlarged view of essential parts of FIG. 2.

FIG. 3 is an enlarged view of essential parts of FIG. 2, illustrating the structure of the rear end of the grip 10.

The characteristic features of the grip 10 according to this embodiment are that, as shown in FIG. 2 and FIG. 3, a certain region 12 at the rear end of the grip 10 has a double structure, and that an outer portion (grip main body 14 to be described later) of this region 12 has a lower hardness than the inner portion (cylindrical portion 13 to be described later). In other words, in the region 12 mentioned above, the outer portion of the grip 10 is softer and the inner portion is harder. The grip 10 with such a structure provides a better feel of grip when the golfer grasps the grip 10, and also, the torsion rigidity of the grip 10 is effectively improved at low cost.

[Grip Structure]

As shown in FIG. 2 and FIG. 3, the grip 10 includes a grip main body 14 and an end cap 15 provided in a rear end portion 17 of the grip main body 14. While the grip 10 as a whole has a cylindrical shape as mentioned above, the grip 10 has a distal end portion 16 with a smaller outer diameter than the rear end portion 17 thereof. Accordingly, the grip 10 has a tapered contour, becoming gradually thicker from the distal end portion 16 toward the rear end portion 17. The grip 10 having such a shape enables the golfer to take a firm hold of the grip 10. The total length of the grip 10 is 260 mm in this embodiment. The total length of the grip may be, typically, but not particularly limited to, about 250 mm to 270 mm.

[Grip Main Body]

As FIG. 1 and FIG. 2 illustrate, the grip main body 14 is made of resin (corresponding to "a first resin" stated in the claims). The grip main body 14 is formed by injection molding. As will be described later, the grip main body 14 is made by insert molding, with the end cap 15 being the insert. The resin forming the grip main body 14 is not limited to a particular type. The grip main body 14 of this embodiment has a hardness of 50 (according to JIS K 6253 Type A). The hardness should preferably be from 45 to 55 (according to JIS K 6253 Type A), and more preferably, from 48 to 52 (according to JIS K 6253 Type A). However, the hardness of the grip main body 14 is not limited to a particular range as long as it is lower than that of the end cap 15, namely, as long as the grip main body 14 is made of a material physically softer than the end cap 15.

The grip main body 14 has a cylindrical shape, its outer shape being tapered. In this embodiment, the distal end 16 of the grip main body 14 has an outer diameter D1 of 19 mm, while the rear end 17 has an outer diameter D2 of 26 mm. The grip main body 14 grows gradually thicker from the distal end 16 toward the rear end 17. As FIG. 3 illustrates, the outer diameter D2 of the rear end 17 of the grip main body 14 is equal to the outer diameter of an end face plate 18 of the end cap 15.

The grip main body 14 is made by insert molding, with the end cap 15 being the insert, as mentioned above. In particular, this embodiment employs a so-called pin gate for the molding operation. As FIG. 3 illustrates, the grip main body 14 is molded with the resin such as to circumferentially encircle and cover a cylindrical portion 13 of the end cap 15. Thereby the grip main body 14 and the end cap 15 are reliably and firmly joined and united together.

With the grip main body 14 thus made by insert molding, the grip 10 shown in FIG. 1 is formed. Due to the use of the pin gate mold in this embodiment, a so-called gate mark 19 is left in a rear end portion of the grip main body 14. This gate mark 19 appears as a circular recess. The position of the gate mark 19 corresponds to a hole 21 formed in the end cap 15 to be described later in detail. The gate mark 19 has a very small inner diameter, which is, in this embodiment, 1.5 mm to 2.5 mm. Since the grip main body 14 is cylindrically shaped, the gate mark 19 is orthogonal to a center axis 20 of the grip main body (which coincides with the center axis of the grip 10). Therefore, the gate mark 19 functions as a mark that indicates the center of the grip 10. In this embodiment, this gate mark 19 is colored. Coloring is achieved by application of ink or any other known means, whereby the center of the grip 10 is recognizable at a glance.

[End Cap]

Figure 4:
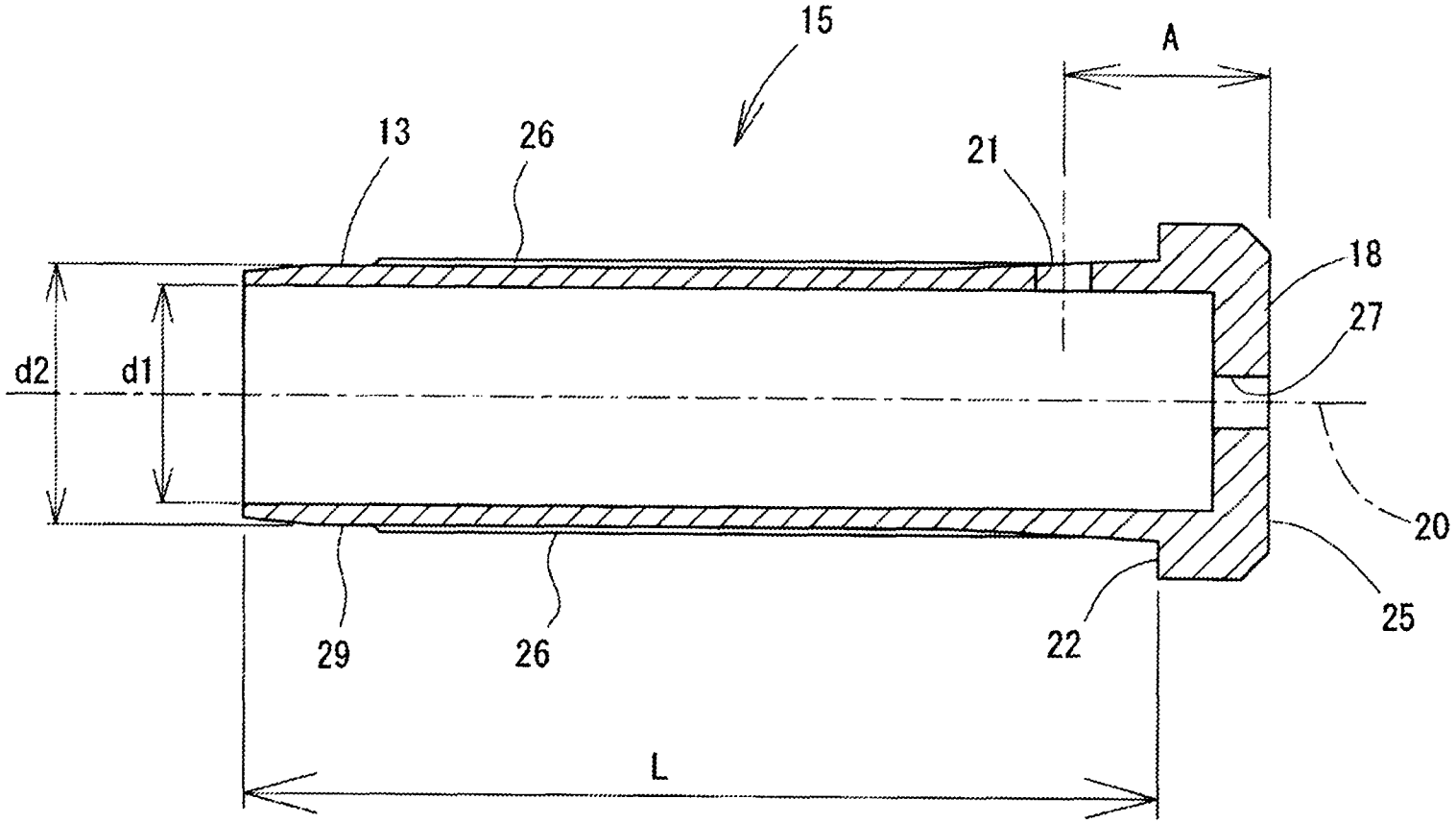
FIG. 4 is a sectional view of an end cap according to one embodiment of the present invention.
Figure 5:
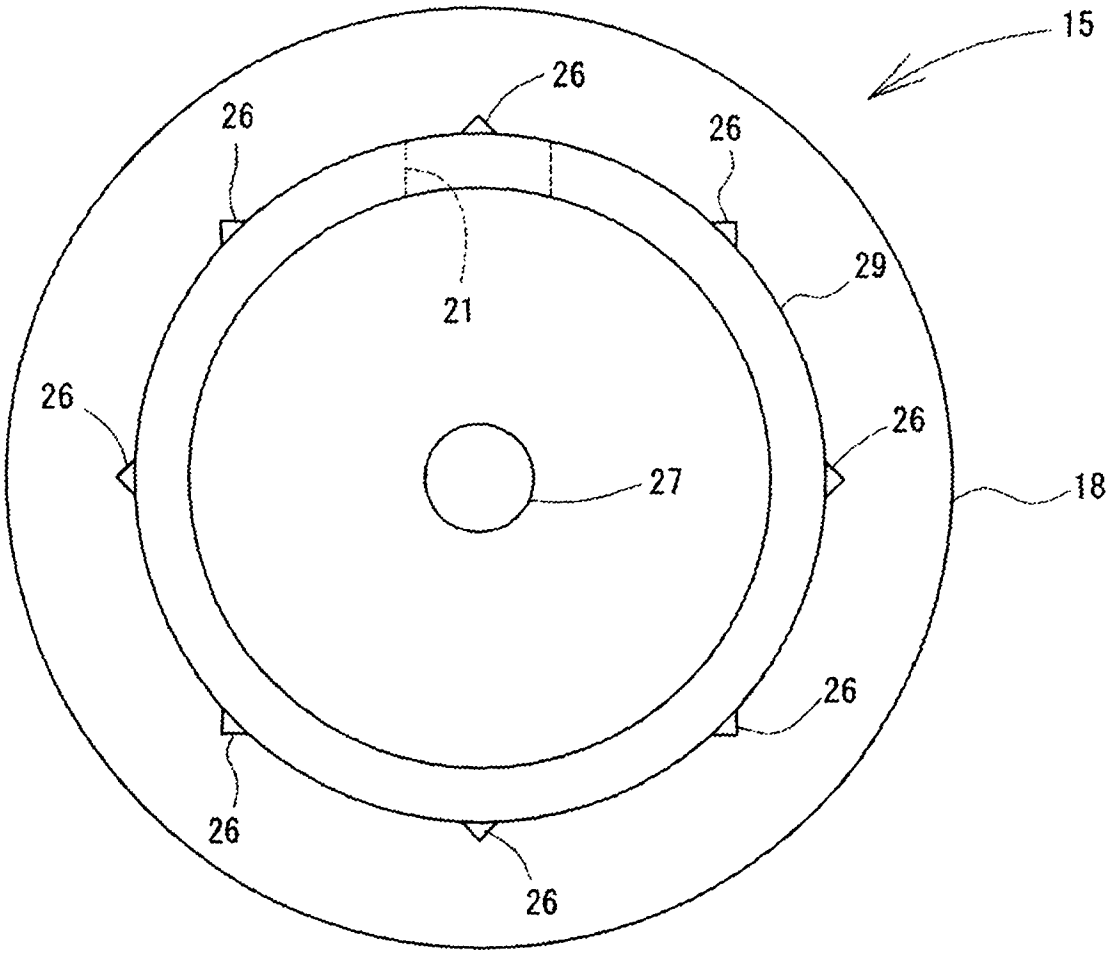
FIG. 5 is a right side view of the end cap 15.
Figure 6:
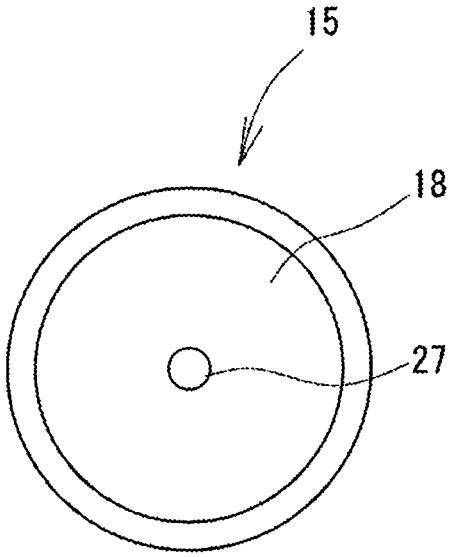
FIG. 6 is an enlarged left side view of the end cap 15.

FIG. 4 is a sectional view of the end cap 15. FIG. 5 and FIG. 6 are a right side view and an enlarged left side view of the end cap 15, respectively.

The end cap 15 is arranged at the rear end portion 17 of the grip main body 14 to form a grip end as shown in FIG. 1 and FIG. 2. The end cap 15 includes the cylindrical portion 13 mentioned above and an end face plate 18 as shown in FIG. 4. A stepped portion 22 is formed at the boundary between these cylindrical portion 13 and end face plate 18, so that the end face plate 18 extends radially from the end face of the cylindrical portion 13. The cylindrical portion 13 is formed integrally with the end face plate 18 and made of resin (corresponding to "a second resin" stated in the claims). The end cap 15 is formed by injection molding using a die set. The resin forming the end cap 15 is not limited to a particular type. The end cap 15, however, should have a hardness of 75 to 80 (according to JIS K 6253 Type A). The end cap 15 of this embodiment has a hardness of 75 (according to JIS K 6253 Type A).

The cylindrical portion 13 is generally cylindrically shaped, and inserted into the rear end portion 17 of the grip main body 14 as shown in FIG. 1 and FIG. 2. In this embodiment, as shown in FIG. 4, the cylindrical portion 13 has an inner diameter d1 of 16 mm, and an outer diameter d2 of 19 mm. However, since the end cap 15 is an insert of the grip main body 14, these dimensions d1 and d2 may suitably be changed to match the size of the grip main body 14.

More specifically, with the end cap 15 provided in the grip main body 14, as shown in FIG. 3, the grip main body 14 is separated into an outer layer 23 and an inner layer 24 in the region 12 mentioned above. In this embodiment, the dimensions d1 and d2 are set such that the wall thickness t1 of the outer layer 23 is 1.4 mm. The wall thickness t1 of the outer layer 23 is not limited to 1.4 mm and may be in the range of 0.8 mm to 2.0 mm. The advantageous effects of this wall thickness t1 being set to the dimensional range above will be described later. Determining the wall thickness t1 of the outer layer 23 in the dimensional range above automatically determines the wall thickness t2 of the inner layer 24. This wall thickness t2 is not limited to a particular value.

The length L of the cylindrical portion 13 (length of the region 12), as shown in FIG. 4, is 65 mm in this embodiment. This length L is, however, set to about 55 mm to 80 mm, and in particular, should preferably be in the range of 60 mm to 75 mm. The effects of this length L of the cylindrical portion 13 being set to this dimensional range will be described later.

A hole 21 is provided in a rear end portion of the cylindrical portion 13. This hole 21 extends radially through the cylindrical portion 13, at a position spaced a predetermined distance A from an end face 25 of the end cap 15. In this embodiment, the hole 21 has an inner diameter of 4 mm. The hole 21 may have an inner diameter of 2.7 mm to 3.5 mm. In this embodiment, the distance A is 15 mm. This distance A is not necessarily limited to 15 mm, but the hole 21 should preferably be disposed close to the stepped portion 22. This hole 21 corresponds to the gate when the grip main body 14 is molded as described above. Accordingly, resin is fed through this hole 21 into the cavity in the pin gate mold.

As shown in FIG. 4 and FIG. 5, the cylindrical portion 13 is formed with a plurality of ribs 26 (corresponding to "engaging protrusions" stated in the claims). The ribs 26 each extend in the axial direction 20 (corresponding to "a longitudinal direction" stated in the claims) in the form of a thin long bar. Each rib 26 is formed integrally with the cylindrical portion 13 by injection molding. In this embodiment, as shown in FIG. 5, eight ribs 26 are formed on an outer circumferential surface 29 of the cylindrical portion 13. The ribs 26 are arranged parallel to each other circumferentially at predetermined intervals on the cylindrical portion 13. More specifically, the ribs 26 are disposed at eight circumferentially equally spaced positions on the outer circumferential surface of the cylindrical portion 13. While the plurality of ribs 26 are regularly and substantially equally spaced from each other in this embodiment, the ribs 26 may not necessarily be substantially equally distributed. The number of ribs 26 is not particularly limited, either.

Figure 7:
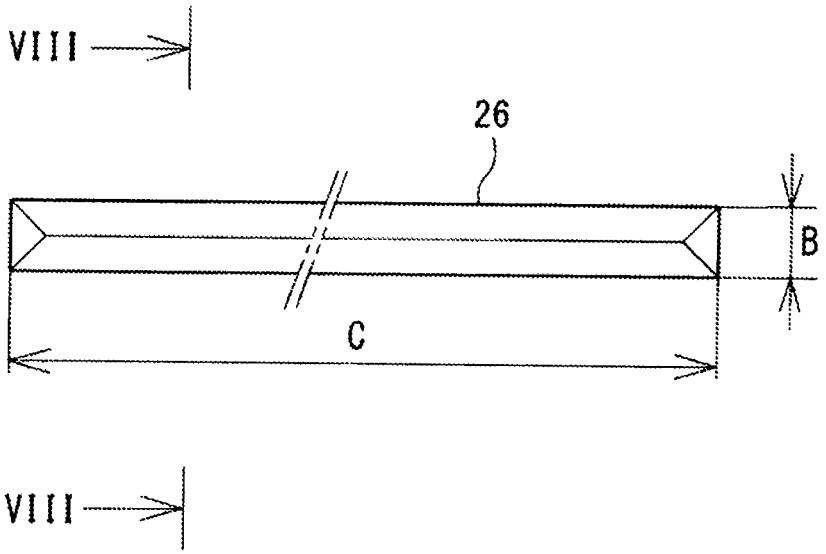
FIG. 7 is an enlarged plan view of a rib according to one embodiment of the present invention.
Figure 8:
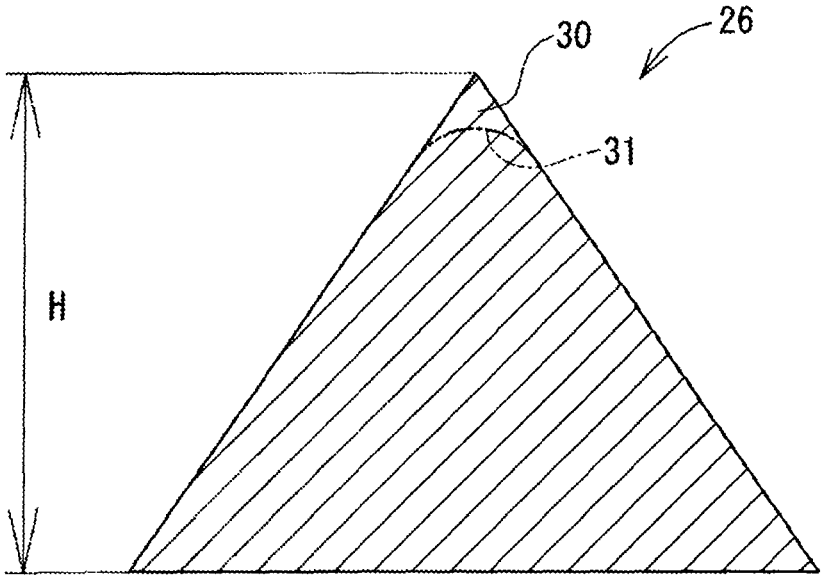
FIG. 8 is a sectional view along VIII-VIII in FIG. 7.

FIG. 7 is an enlarged plan view of a rib 26, and FIG. 8 is a sectional view along VIII-VIII in FIG. 7, illustrating a cross section of the rib 26 to a larger scale.

In this embodiment, the ribs 26 have a triangular sectional (cross-sectional) shape. Thus, distal ends 30 of the ribs 26 protrude toward the grip main body 14. The sectional shape of the ribs 26 need not be an equally sided triangle, but the ribs should preferably have a shape with pointed distal ends 30. The ribs 26 have a width B of 1.0 mm, a length C of 50.0 mm, and a height H of 0.7 mm. However, the width B, length C, and height H of the ribs 26 are not limited to the dimensions specified above and may be changed suitably. The height H, in particular, may be in the range of 0.4 mm to 1.4 mm. The advantageous effects of the ribs 26 having a triangular sectional shape will be described later.

The end face plate 18 is formed in a disc-like shape and continuous with the rear end of the cylindrical portion 13 as shown in FIG. 4 and FIG. 6. The outer diameter of the end face plate 18 is made the same as the outer diameter D2 of the rear end portion 17 of the grip main body 14, which is, in this embodiment, 26 mm. The end face plate 18 is orthogonal to the cylindrical portion 13 (namely, orthogonal to its center axis 20). With the cylindrical portion 13 inserted in the grip main body 14, the end face plate 18 is disposed to close the rear end of the grip main body 14 as shown in FIG. 3. A through hole 27 is provided at the center of the end face plate 18. This through hole 27 may be omitted.

[Fabrication of Grip]

The grip 10 is made from a resin material by molding using a pin gate mold as mentioned above.

More specifically, first, the end cap 15 (see FIG. 4) is formed by injection molding with the hard resin (second resin) (first step). Any of known molding techniques may be applied for this step, employing any of molds with various gates such as direct gate, side gate, pin gate, submarine gate, hot runner gate, and others.

Next, the grip main body 14 is formed. The grip main body 14 is also formed by injection molding, and the grip 10 is thereby completed. The grip main body 14 is formed using a pin gate mold with the soft resin (first resin).

The end cap 15 formed in the first step is set in the pin gate mold as an insert. More specifically, the hole 21 of the end cap 15 is aligned with the gate of the pin gate mold, and in this state the end cap 15 is mounted to the pin gate mold (second step). Successively, with the pin gate mold being clamped, the soft resin is injected from the gate into the cavity of the mold (third step). The pin gate mold is then opened, and the grip 10 that is molded is taken out (fourth step).

In this way, as the grip 10 is formed using a pin gate mold, the molded product (grip 10) has less residual stress, so that the so-called swirl deformation is prevented. In other words, the number of defective products is reduced. Also, since the gate mark is very small, the process of removing gate marks is no longer necessary. That is, while a process step of cutting off gate marks would be included in the manufacturing process with conventional molding, such step is made unnecessary by the use of a pin gate mold, so that the manufacturing process is simplified.

Nevertheless, gate marks are left inevitably. However, since the gate mark appears near the rear end of the grip 10, this can be used as a mark that indicates the center of the grip 10. In other words, the use of the pin gate mold not only reduces the defect rate, but also provides the advantage that the small, inevitably formed gate mark can function as the mark indicative of the center of the grip 10.

[Advantageous Effects of Grip]

This grip 10 is mounted to the shaft 11 of the golf club in the state shown in FIG. 1. The golfer grasps the grip 10 and swings the golf club. The golf club head thus hits a ball, so that the ball travels in a predetermined direction.

The grip 10 has the double structure as described above, with the grip main body 19 and the end cap 15 being firmly secured to each other. The golfer will hold the grip main body 19 when grasping the grip 10. Since the grip main body 14 is made of a resin softer than that of the end cap 15, it provides a good feel of grip for the golfer. In this embodiment, in particular, the grip main body 14 having a hardness of 48 to 52 (according to JIS K 6253 Type A) provides the golfer with a very good feel of grip when the golfer grasps the grip 10.

As the grip 10 has the double structure with the grip main body 19 and the end cap 15, there is the cylindrical portion 13 made of a harder material inside the grip main body 14. As shown in FIG. 3, the wall thickness of the grip main body 14 is a total sum of the wall thickness t1 of the outer layer 23, wall thickness t2 of the inner layer 24, and the wall thickness of the cylindrical portion 13 (d2/2−d1/2). The wall thickness of the grip main body 19 is naturally determined within a certain range that allows an easy grip for the golfer. Therefore, because of the presence of the cylindrical portion 13 made of a hard material, the wall thickness of the soft-material portion of the grip main body 14 (i.e., the wall thickness t1 of the outer layer 23) is relatively smaller than when there is no cylindrical portion 13.

The impact when the golfer hits the ball acts on the grip 10 as a couple of forces and causes torsional deformation in the grip main body 14. The degree of this torsional deformation largely depends on deformation of the grip main body 14 made of a soft resin. With the grip 10 according to this embodiment, with the cylindrical portion 13 made of a hard material being inserted in the grip main body 14, the wall thickness t1 of more deformable portion (outer layer 23) of the grip main body 14 is reduced. As a result, the grip main body 14 has improved torsional rigidity.

With the torsional rigidity of the grip main body 14 improved, naturally, the grip 10 has improved torsional rigidity. This makes the grip 10 less twisted when the golfer hits the ball. Therefore, the impact angle between the ball and the clubface at the hitting moment is maintained at right angles. This as a result brings about the effect that the ball will travel in a direction as intended by the golfer.

In this embodiment, moreover, the torsion rigidity is improved only in part (region 12) of the grip main body 14. In other words, the double structure that reduces torsional deformation of the grip main body 14 is formed only in the region 12. Therefore, the production cost of the grip 10 is much reduced as compared to forming the double structure over the entire span in the axial direction 20 of the grip main body 14.

In this embodiment, a plurality of ribs 26 (see FIG. 4 and FIG. 5) are provided to the cylindrical portion 13 of the end cap 15, these ribs 26 engaging with the grip main body 14. Specifically, as the grip main body 14 is formed by insert molding with the end cap 15 being the insert, the ribs 26 protrude toward and bite into the grip main body 14. The end cap 15 and the grip main body 14 are thus firmly joined to each other. Therefore, displacement of the grip main body 14 relative to the end cap 15 when a couple of forces acts on the grip 10 is reduced. In addition, since the ribs 26 bite into the grip main body 14, the wall thickness of the grip main body 14 (wall thickness t1 of the outer layer 23) is further reduced at portions where the ribs 26 are provided. This correspondingly reduces deformation of the grip main body 14, further reducing the amount of twist in the grip 10.

In this embodiment, the ribs 26 are circumferentially equally arranged on the entire outer circumferential surface 29 of the cylindrical portion 13 as shown in FIG. 5. That is, portions without the ribs 26 are also evenly distributed. In other words, the grip 10 has portions with a relatively large wall thickness of the grip main body 14 uniformly distributed on the entire outer circumferential surface of the grip 10. Thus, the advantage of further improving the feel of grip is provided when the golfer grasps the grip while maintaining high torsional rigidity of the grip 10.

In this embodiment, in particular, the ribs 26 extend along the axial direction 20 of the grip main body 14. Therefore, the ribs 26 function as keys connecting the grip main body 14 and the end cap 15. The ribs thus provide the advantage of joining the end cap 15 and the grip main body 14 even more firmly, so that the grip 10 has even higher torsional rigidity.

Moreover, in this embodiment, the ribs 26 have a triangular cross-sectional shape, i.e., protrude toward the grip main body 14, as shown in FIG. 5 and FIG. 8. Therefore, the distal ends 30 of the ribs 26 melt and fuse with the grip main body 14 during insert molding of the grip main body 14. In actuality, the distal ends 30 of the ribs 26 take on a shape illustrated by a two-dot-chain line 31 in FIG. 8. Thereby, the joint between the end cap 15 and the grip main body 14 is made even firmer, so that the grip 10 has even higher torsional rigidity.

While the ribs 26 have a triangular cross-sectional shape in this embodiment, the ribs 26 may have other cross-sectional shapes such as semi-circular or the like. The minimum requirement is that the cylindrical portion 13 be provided on its outer circumferential surface 29 with a member protruding toward the grip main body 14 to engage therewith. The ribs 26 may be omitted.

EXAMPLES

While the effects of the present invention will become apparent by description of examples below, these examples should not be interpreted as limiting the present invention.

General dimensional data applicable to all the sample grips in the examples are as follows. Twistability (torsional rigidity) of the sample grips was measured with varying lengths of the cylindrical portion of the end cap.

<General Dimensional Data>

The total length of the sample grips is 260 mm, with the distal end outer diameter being 16 mm, and the rear end outer diameter being 26 mm. The wall thickness of the outer layer of the grip main body of the sample grips is 1.4 mm. The grip main body is formed from resin having a hardness of 50 (according to JIS K6253 Type A), and the end cap is formed from resin having a hardness of 75 (according to JIS K6253 Type A). Eight ribs are provided to the cylindrical portion of the end cap. The ribs are circumferentially equally arranged on the outer circumferential surface of the cylindrical portion. Each rib 26 has a width of 1.0 mm, a length of 50.0 mm, and a height of 0.7 mm.

Example 1

The length 12 (see FIG. 3) of the cylindrical portion is 60 mm.

Example 2

The length 12 (see FIG. 3) of the cylindrical portion is 63 mm.

Example 3

The length 12 (see FIG. 3) of the cylindrical portion is 66 mm.

Example 4

The length 12 (see FIG. 3) of the cylindrical portion is 69 mm.

Example 5

The length 12 (see FIG. 3) of the cylindrical portion is 72 mm.

Example 6

The length 12 (see FIG. 3) of the cylindrical portion is 75 mm.

Comparative Example 1

The length 12 (see FIG. 3) of the cylindrical portion is 80 mm.

Comparative Example 2

The length 12 (see FIG. 3) of the cylindrical portion is 90 mm.

Comparative Example 3

The length 12 (see FIG. 3) of the cylindrical portion is 57 mm.

Comparative Example 4

The length 12 (see FIG. 3) of the cylindrical portion is 54 mm.

Comparative Example 5

The length 12 (see FIG. 3) of the cylindrical portion is 51 mm.

Comparative Example 6

The length 12 (see FIG. 3) of the cylindrical portion is 48 mm.

Comparative Example 7

The length 12 (see FIG. 3) of the cylindrical portion is 40 mm.

Comparative Example 8

The length 12 (see FIG. 3) of the cylindrical portion is 30 mm.

<Test Method>

Figure 11:
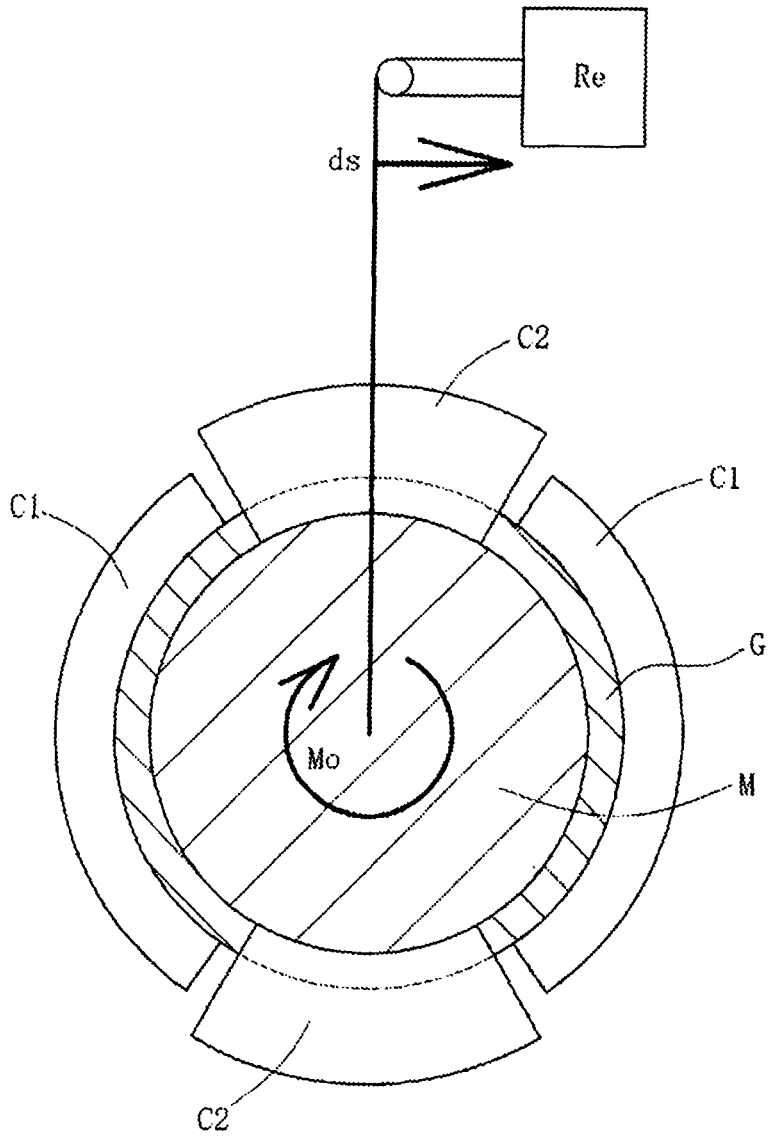
FIG. 11 is a model view illustrating the principle of the method of testing sample grips.
Figure 12:
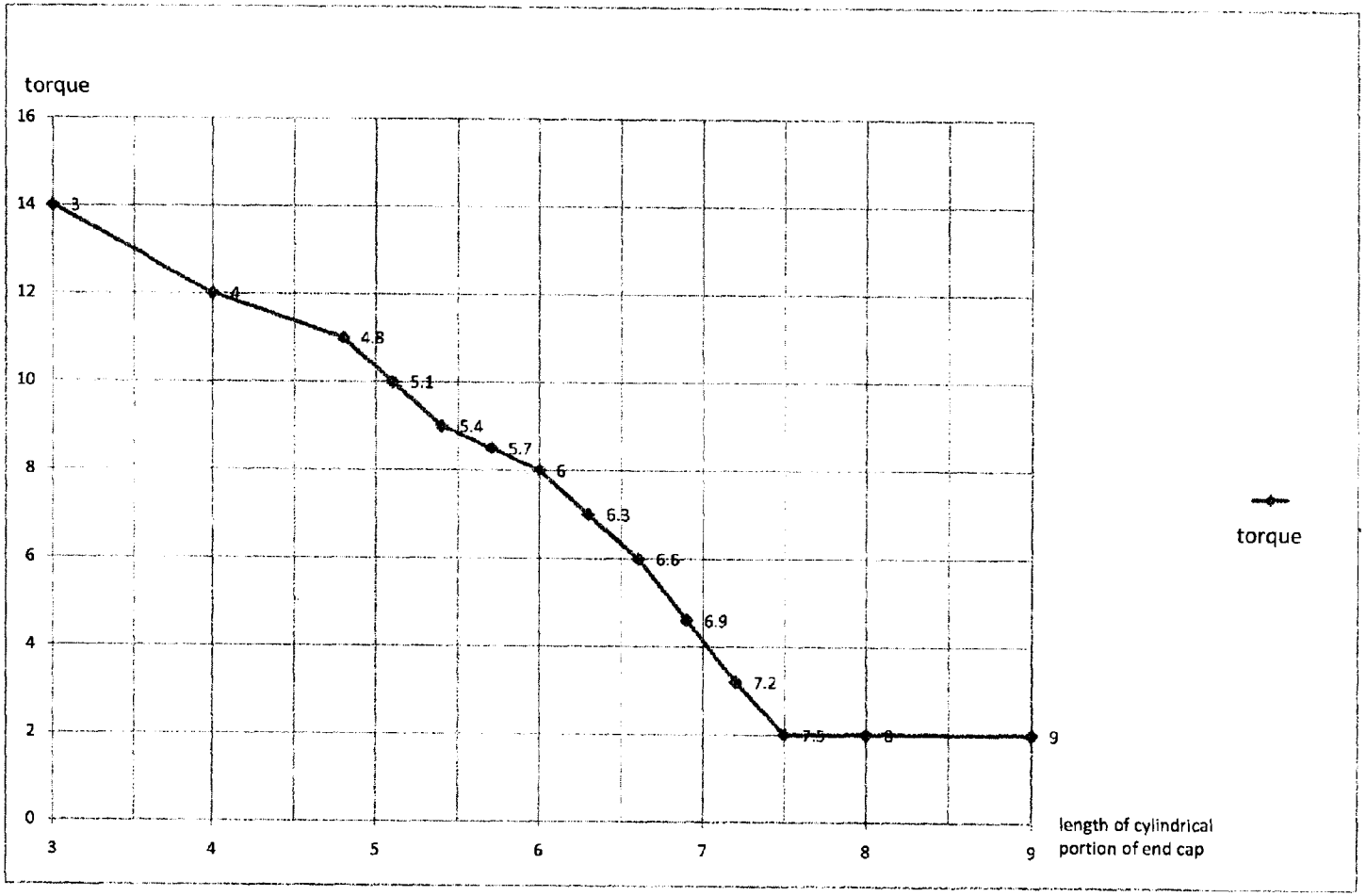
FIG. 12 is a graph (Table 1) of the results of tests performed on an embodiment of the present invention.

FIG. 11 is a sectional view of a sample grip, illustrating the principle of the test method.

The sample grip G is fitted and fastened on a metal core M. This fastening is achieved in a similar manner as when the grip is mounted on a typical golf club shaft. The sample grip G is held between holders C1, and the metal core M is also fixed by means of holders C2. The holders C1 are formed such as to hold the sample grip G circumferentially generally uniformly. The holding pressure applied by the holders C1 on the sample grip G is set similar to a typical grip pressure applied by a golfer during a game of golf (90 kgf measured as a grip strength). In this state, a torsional moment Mo of 60 kgf·cm is applied to the metal core M, and the amount of torsional deformation ds of the metal core M is measured using a micrometer Re.

Table 1 shows the test results. The horizontal axis of Table 1 represents the length of the cylindrical portion of the end cap, the unit being "cm". The vertical axis of Table 1 represents the amount of torsional deformation ds measured using a micrometer and indicated as dimensionless values. The amount of torsional deformation ds is indicated as dimensionless values because the measurements are extremely small. For convenience of explanation, the measurements are referred to as a "torque", smaller torques meaning a small amount of torsional deformation and indicating excellent torque performance of the sample grip. This test assumes that the intended torque performance is achieved when the torque is 8.0 or lower.

The test revealed that when the length of the cylindrical portion of the end cap was shorter than 60 mm, the measured torque showed a significant increase. Further, the test revealed that when the length of the cylindrical portion of the end cap was 60 mm or more, the torque could be maintained sufficiently low. The test also revealed that, the measured torque showed no changes if the length of the cylindrical portion of the end cap was 75 mm or more, and the measured torque remained the same however much longer the length of the cylindrical portion was over 75 mm.

As shown in Table 1, the present inventor found out that the grip 10 exhibited sufficient torsional rigidity and high torque performance only by setting the length of the cylindrical portion 13 (see FIG. 3) as specified in various examples above. That is, the torque performance of the grip 10 is improved even though the cylindrical portion 13 is not present over the entire length of the grip main body 14.

Modified Example

Figure 9:
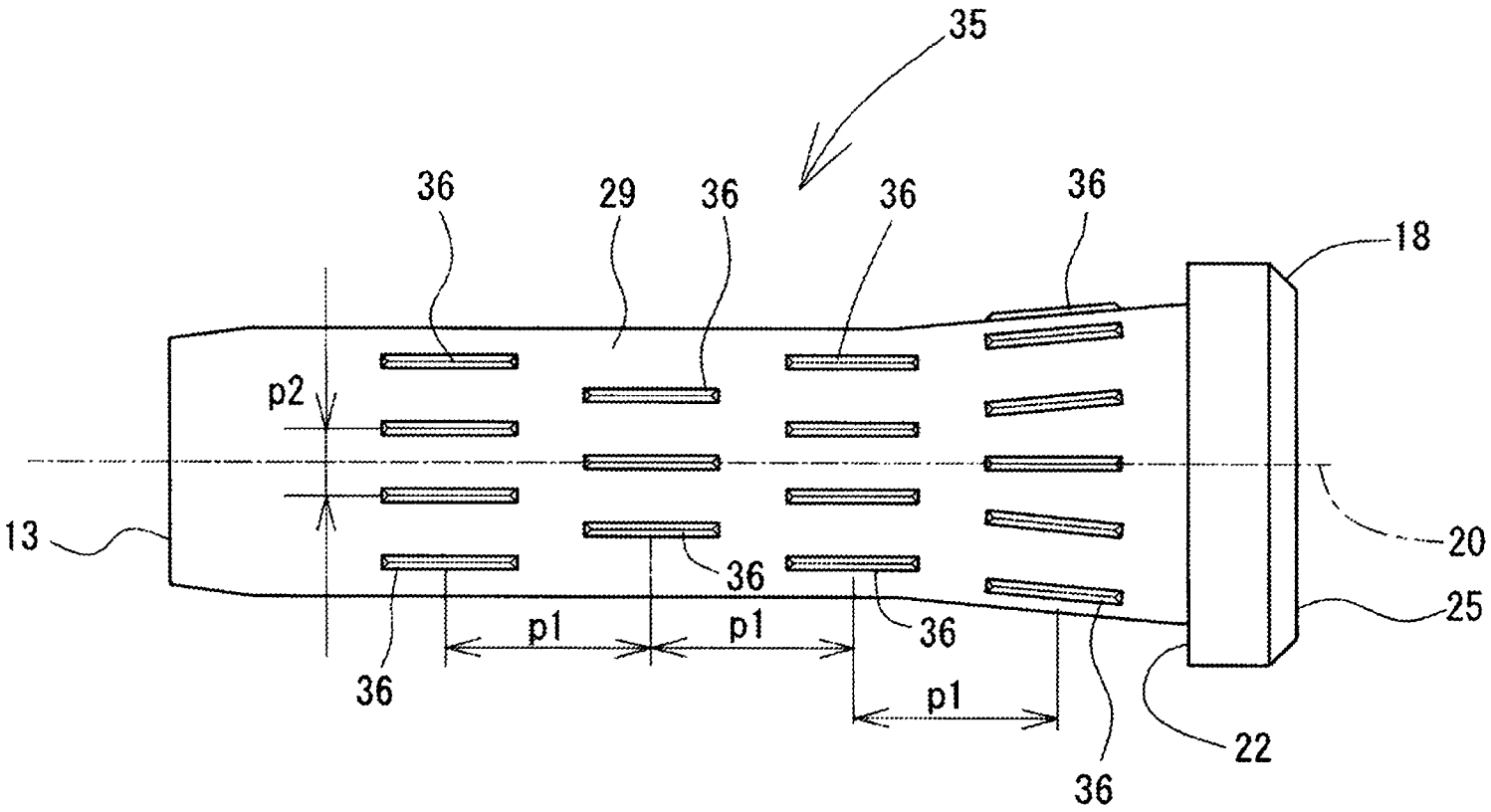
FIG. 9 is a front view of an end cap according to a first modified example of the embodiment.

FIG. 9 is a front view of an end cap 35 according to a first modified example of this embodiment.

The end cap 35 according to this modified example is different from the end cap 15 of the previously described embodiment in that, while the ribs 26 each extend along the cylindrical portion 13 from near the rear end to near the distal end (see FIG. 4) in the previously described embodiment, ribs 36 are divided into a plurality of segments along the axial direction 20 and arranged intermittently in this modified example. Specifically, ribs 36 having a smaller longitudinal dimension are distributed on the outer circumferential surface 29 of the cylindrical portion 13 with an axial interval p1 and a circumferential interval p2.

With such a structure, the portions without the ribs 36, i.e., the portions having a relatively larger wall thickness of the grip main body 14, are evenly distributed in both axial and circumferential directions. The advantage of further improving the feel of grip is provided when the golfer grasps the grip 10 is provided, while maintaining high torsional rigidity of the grip 10.

Figure 10:
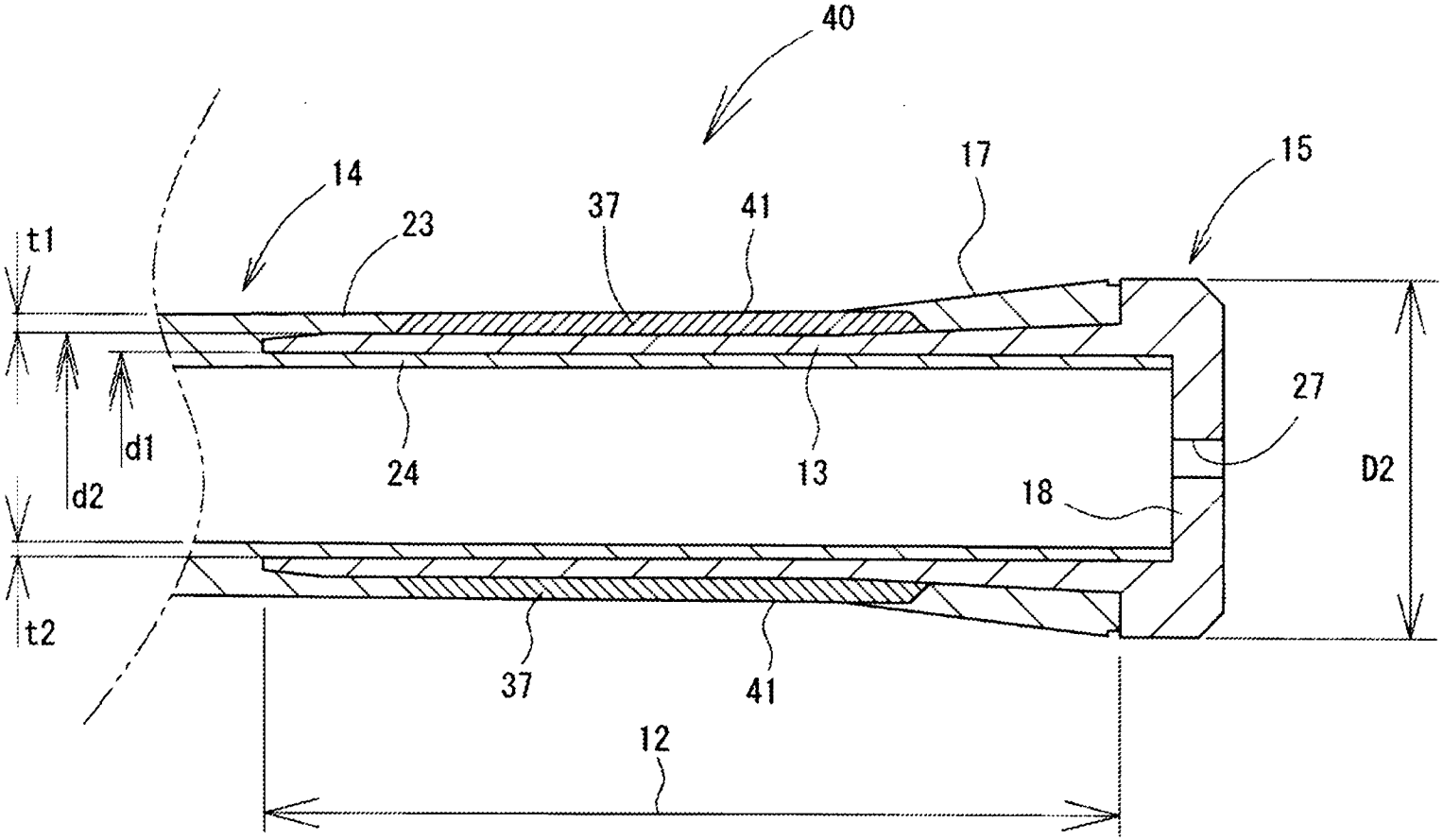
FIG. 10 is an enlarged sectional view of essential parts of a grip according to a second modified example of the embodiment.

FIG. 10 is an enlarged sectional view of essential parts of a grip 40 according to a second modified example of this embodiment.

As shown in the figure, the grip 40 according to this modified example is different from the grip 10 of the previously described embodiment in that, while the ribs 26 are embedded in the grip main body 14 in the previously described embodiment, ribs 37 in this modified example are exposed on the surface 41 of the grip main body 14. Other features of the grip 40 are the same as those of the grip 10.

With the ribs 37 being exposed on the surface 41 of the grip main body 14 in this manner, the distal end faces of the exposed ribs 37 contact the hands of the golfer when the golfer grasps the grip 40. Since these ribs 37 are made of a hard resin as described above, they make reliable contact with the golfer's hands. That is, the advantage of a high slip prevention effect is provided. The same effect would be achieved, however, even though the ribs 37 are not entirely exposed on the surface 41 but the tops of the ribs 37 extend as far as close to the surface 41.

DESCRIPTION OF REFERENCE SIGNS

10 grip
12 region
13 cylindrical portion
14 grip main body
15 end cap
19 gate mark
21 hole
23 outer layer
24 inner layer
26 rib
29 outer circumferential surface
35 end cap
36 rib
37 rib
40 grip
41 surface

The invention claimed is:

1. A golf club grip comprising a cylindrical grip main body made of a first resin, and an end cap made of a second resin having a higher hardness than the first resin, the end cap being provided at a rear end portion of said grip main body to form a grip end, said grip main body being made by insert molding with said end cap being an insert, said end cap including a cylindrical portion inserted into the rear end portion of said grip main body, and an end face plate closing a rear end of said grip main body, and said cylindrical portion having a length of 60 mm to 75 mm;

wherein said grip main body is molded using a pin gate mold, and said cylindrical portion has a hole corresponding to a gate of said pin gate mold, the hole extending radially through a rear end portion of the cylindrical portion; and wherein said cylindrical portion is formed with an engaging protrusion on an outer circumferential surface thereof to engage with said grip main body, the engaging protrusion having a distal end portion being fused with said grip main body by said insert molding.

2. The golf club grip according to claim 1, wherein a plurality of engaging protrusions are arranged circumferentially at predetermined intervals on the outer circumferential surface of said cylindrical portion.

3. The golf club grip according to claim 2, wherein said engaging protrusion has a triangular cross-sectional shape with said distal end portion thereof protruding toward said grip main body.

4. The golf club grip according to claim 3, wherein said engaging protrusion extends as far as to or near a surface of said grip main body.

5. The golf club grip according to claim 2, wherein said engaging protrusion is a rib extending in a longitudinal direction of said cylindrical portion.

6. The golf club grip according to claim 5, wherein said engaging protrusion extends as far as to or near a surface of said grip main body.

7. The golf club grip according to claim 2, wherein said engaging protrusion extends as far as to or near a surface of said grip main body.

8. The golf club grip according to claim 1, wherein said engaging protrusion has a triangular cross-sectional shape with said distal end portion thereof protruding toward said grip main body.

9. The golf club grip according to claim 8, wherein said engaging protrusion is a rib extending in a longitudinal direction of said cylindrical portion.

10. The golf club grip according to claim 9, wherein said engaging protrusion extends as far as to or near a surface of said grip main body.

11. The golf club grip according to claim 8, wherein said engaging protrusion extends as far as to or near a surface of said grip main body.

12. The golf club grip according to claim 1, wherein said engaging protrusion is a rib extending in a longitudinal direction of said cylindrical portion.

13. The golf club grip according to claim 12, wherein said engaging protrusion extends as far as to or near a surface of said grip main body.

14. The golf club grip according to claim 1, wherein said engaging protrusion extends as far as to or near a surface of said grip main body.

15. The golf club grip according to claim 1, wherein said first resin has a hardness of 48 to 52 (according to JIS K 6253 Type A).

16. The golf club grip according to claim 15, wherein said engaging protrusion extends as far as to or near a surface of said grip main body.

17. A method of manufacturing the golf club grip according to claim 1, comprising:

a first step of forming said end cap by injection molding with said second resin;

a second step of mounting the end cap in said pin gate mold, with said hole of the injection-molded end cap being aligned with the gate of said pin gate mold;

a third step of injecting said first resin from said gate, with said pin gate mold being clamped; and a fourth step of removing a molded golf club grip after said pin gate mold is opened.

* * * * *